United States Patent [19]

Kajioka et al.

[11] Patent Number: 4,709,899

[45] Date of Patent: Dec. 1, 1987

[54] CLIMBING FORMWORK APPARATUS FOR CONCRETE PLACING

[75] Inventors: Yasuo Kajioka; Tomio Komine; Hitoshi Kadowaki; Shigeyoshi Matsuda; Yoshinori Yugami; Shinya Kubota; Yoshio Takahashi; Hiroshi Shimada; Nobutaka Kurata, all of Tokyo, Japan

[73] Assignee: Shimizu Construction Co., Ltd., Tokyo, Japan

[21] Appl. No.: 923,428

[22] Filed: Oct. 27, 1986

[30] Foreign Application Priority Data

| | | | |
|---|---|---|---|
| Oct. 28, 1985 | [JP] | Japan | 60-241050 |
| May 10, 1986 | [JP] | Japan | 61-106956 |
| May 15, 1986 | [JP] | Japan | 61-111615 |
| May 15, 1986 | [JP] | Japan | 61-111616 |
| May 27, 1986 | [JP] | Japan | 61-121706 |
| May 27, 1986 | [JP] | Japan | 61-80111[U] |
| Sep. 16, 1986 | [JP] | Japan | 61-141501[U] |

[51] Int. Cl.[4] ..... E04G 11/28

[52] U.S. Cl. ..... 249/20; 249/10; 249/94; 249/170; 249/219 R; 264/33; 264/35; 425/65

[58] Field of Search ..... 249/13, 19, 20, 21, 249/17, 83, 93, 94, 97, 188, 210, 213, 219 R, 10, 170; 425/63–65; 264/33–35

[56] References Cited

U.S. PATENT DOCUMENTS

| | | | |
|---|---|---|---|
| 1,014,630 | 1/1912 | Morrill | 249/20 |
| 1,478,653 | 12/1923 | Holmes | 249/20 |
| 1,647,685 | 11/1927 | Cooper | 249/20 |
| 1,918,182 | 7/1933 | Eiler | 249/20 |
| 2,738,563 | 3/1956 | Steele | 249/20 |

FOREIGN PATENT DOCUMENTS

| | | | |
|---|---|---|---|
| 2405414 | 8/1974 | Fed. Rep. of Germany | 249/20 |
| 1129580 | 1/1957 | France | 249/20 |
| 2239130 | 2/1975 | France | 249/20 |

*Primary Examiner*—Jay H. Woo
*Assistant Examiner*—James C. Housel
*Attorney, Agent, or Firm*—Scully, Scott, Murphy & Presser

[57] ABSTRACT

A formwork apparatus for concrete placing comprises: a center frame assembly having upper and lower ends; first and second form panels for molding concrete walls, each having a supporting member mounted on an outer surface thereof, the first form panel pivotally connected at its supporting member to the upper end of the frame assembly so as to be pivoted about a substantially horizontal axis, the second form panel pivotally connected at its supporting member to the lower end of the frame assembly so as to be pivoted about an axis parallel to a pivot connecting the first panel with the frame assembly; a first fixing mechanism for fixing and releasing the first panel to and from a cured concrete wall; a second fixing mechanism for fixing and releasing the second panel to and from the concrete wall; a first drive mechanism for pivoting the frame assembly around the first panel when the first panel is fixed to the concrete wall so that the second panel is brought to a position upper side of the first panel; and a second drive mechanism for pivoting the frame assembly around the second panel when the second panel is fixed to the concrete wall so that the first panel is brought to a position upper side of the second panel.

25 Claims, 27 Drawing Figures

CLIMBING FORMWORK APPARATUS FOR CONCRETE PLACING

BACKGROUND OF THE INVENTION

The present invention relates to a formwork apparatus used for concrete placing in the constructing of concrete structures such as dams.

Heretofore, sliding forms are used for concrete placing when concrete structures, for example the concrete walls of dams, are built. These sliding forms have form panels which can slide upwards and downwards. Concrete is poured and placed inside these panels. After the concrete is cured, the panels are released from the cured concrete wall and slide upward to replace themselves. In order to release one of the form panels from the concrete wall, two or three workers get on a scaffold attached to the sliding form and sling the panel. Thereafter, they loosen fixing bolts used for fixing the sliding form to the wall, and then come off the scaffold temporarily. Then, a crane hangs up the form panel in order to slide it upwards. After the panel is raised to the position, the workers get on the scaffold again and fix the sliding form, which is still hung by the crane, to the cured concrete wall with the fixing bolts. Again, concrete is then poured inside the form panel, and subsequent operations are continued in the same manner.

As described above, the sliding forms require manual labor and such large scale equipment as a crane for replacement of the form panel, thereby causing the cost of the concrete placing to increase. Moreover, the panel replacement operation is performed in a low safety, low efficiency environment since it must be done at a high altitude on the scaffold. Furthermore, it is impossible to construct a curved concrete wall with the sliding forms because of the difficulty in sliding the panels in curved manner.

SUMMARY OF THE INVENTION

Accordingly, it is an object of the present invention to provide a formwork apparatus which accomplishes the replacement of its form panels automatically, thereby enhancing the safety and efficiency of the replacement operation as well as decreasing the concrete placing expenses.

It is another object of the present invention to provide a formwork apparatus which is capable of constructing a curved concrete wall.

It is a further object of the present invention to provide a formwork apparatus in which it is possible to leave a wide gap between itself and another formwork apparatus without concrete leaking from the gap when it is used in a horizontal alignment with another apparatus, thus avoiding collision.

It is a still further object of the present invention to provide a formwork apparatus which is capable of correcting its position on a concrete wall that is under construction.

With these and other objects in view, the present invention provides a formwork apparatus which includes a center frame assembly having upper and lower ends, and first and second form panels for molding concrete walls. Each of the first and second panels has a supporting member mounted on its outer surface. The first form panel is pivotally connected at its supporting member to the upper end of the frame assembly so as to be pivoted about a substantially horizontal axis. The second form panel is pivotally connected at its supporting member to the lower end of the frame assembly so as to be pivoted about an axis parallel to a pivot connecting the first panel with the frame assembly. The formwork apparatus also includes first and second fixing mechanisms for fixing and releasing the first and second panels respectively to and from a cured concrete wall, a first drive mechanism for pivoting the frame assembly around the first panel when the first panel is fixed to the concrete wall causing the second panel to lift to a position upper side of the first panel, and a second drive mechanism for pivoting the frame assembly around the second panel when the second panel is fixed to the concrete wall causing the first panel to lift to a position upper side of the second panel.

It is preferred that the formwork apparatus has first and second locking mechanisms for locking and unlocking the first and second panels respectively to and from the frame assembly so that they are not pivoted while locked. Each of the first and second locking mechanisms may include a locking pin slidably mounted on the frame assembly or on the corresponding form panel, a locking plate piece attached to the frame assembly, and an engaging plate piece projecting from the outer surface of the corresponding form panel. The engaging piece overlaps the locking piece when the frame assembly is pivoted to a desired position, and the locking pin passes through both the engaging piece and the overlapped locking piece when it slides axially.

Preferably, each of the first and second panels has a substantially quadrangular shape. Therefore, when the lower edge of the first panel is brought into contact with the upper edge of the second panel and when the lower edge of the second panel is brought into contact with the upper edge of the first panel, a sequential inner surface for molding is formed by the inner surfaces of the form panels.

Each of the first and second form panels may have a first elongated joining plate attached parallel to one of the upper and lower edges thereof for eliminating a gap between the first and second form panels, and a second elongated joining plate attached parallel to one of the opposite side edges for eliminating a gap between the corresponding first or second form panel and a form panel of another formwork apparatus. These joining plates are attached preferably by hinges to the panel.

It is preferred that each of the first and second drive mechanisms includes: an electric motor mounted on the frame assembly; a drive arm connected at one of its ends to the drive shaft of the electric motor so as to be rotated about a horizontal axis which is parallel to the pivots connecting the form panels with the frame assembly, the arm having a through slot longitudinally extending in it; and a sliding pin loosely passing through the slot and attached at its opposite ends to the corresponding first or second form panel. In this arrangement, the frame assembly may have a slip ring attached to one of the opposite sides of the frame assembly for electrically connecting the motor to a power source outside the apparatus.

In another arrangement, each of the first and second drive mechanisms may include a cylinder actuator mounted on the corresponding first or second panel, and a crank assembly arranged between the corresponding panel and the frame assembly for changing the reciprocating motion of the actuator's piston rod to the rotary motion of the frame assembly. The actuator may be pivotally connected at one of its ends to the corresponding panel. The crank assembly may include a swing arm pivotally connected at one of its ends to the panel and at the other end to the other end of the actuator, and a connecting arm pivotally connected at one of its ends to the other end of the swing arm and at the other end to the frame assembly at a distance from the pivot connecting the panel with the frame assembly. It is preferable that the distance is smaller than the length of the swing arm.

It is preferred that each of the first and second fixing mechanisms includes: an anchor member to be embedded in the concrete wall, the anchor member having a screw portion; a bolt member loosely passing through the corresponding form panel, the bolt member having a female screw portion at one of its ends for threadedly engaging with the screw portion of the anchor member; a nut member threadedly engaged with the other end portion of the bolt member projecting from the outer surface of the form panel; a drive motor mounted on the outer surface of the form panel; and a clutch assembly arranged between the drive motor and the bolt member for connecting a drive shaft of the drive motor alternately to the bolt member and the nut member.

In place of the clutch assembly, each of the first and second fixing mechanisms,may include a braking mechanism for preventing the bolt member from rotating as long as the bolt member undergoes a torque less than predetermined torque, and a stopper member securing the nut member to the bolt member when the nut member is brought into contact with it. In this arrangement, the nut member should be connected to a drive shaft of the drive motor.

Preferably, the formwork apparatus has first and second position correcting mechanisms for bringing the upper edges of the first and second panels to levels respectively in which the fixing positions of the respective panels are corrected.

Each of the position correcting means may include: a pair of elongated through holes formed in the opposite side edge portions of the corresponding form panel so as to extend along the respective side edges of the form panel; a pair of mobile members connected to the form panel so as to move along the respective elongated holes; adjusting mechanisms for adjusting positions of the respective mobile members relative to the elongated holes so that the mobile members are brought to their respective desired positions; and a pair of anchor bolts passing through both the respective mobile members and the respective elongated holes, the anchor bolts to be embedded in the concrete wall to fix the form panel to the concrete wall.

In another construction, each of the position correcting means may have a guide frame interposed between the corresponding form panel and its supporting member so as to extend along a side edge of the form panel, a pair of pivotal joint pins perpendicularly connected to opposite side edge portions of the form panel, each of the joint pins connected to the guide frame so as to move along the guide frame, and adjusting mechanisms for adjusting positions of the respective joint pins relative to the guide frame so that the joint pins are brought to their respective desired positions.

Preferably, the frame assembly has a scaffold pivotally connected to it, and a docking space defined in it for receiving the scaffold.

DETAILED DESCRIPTION OF THE PREFERRED EMBODIMENTS

Figure 1:
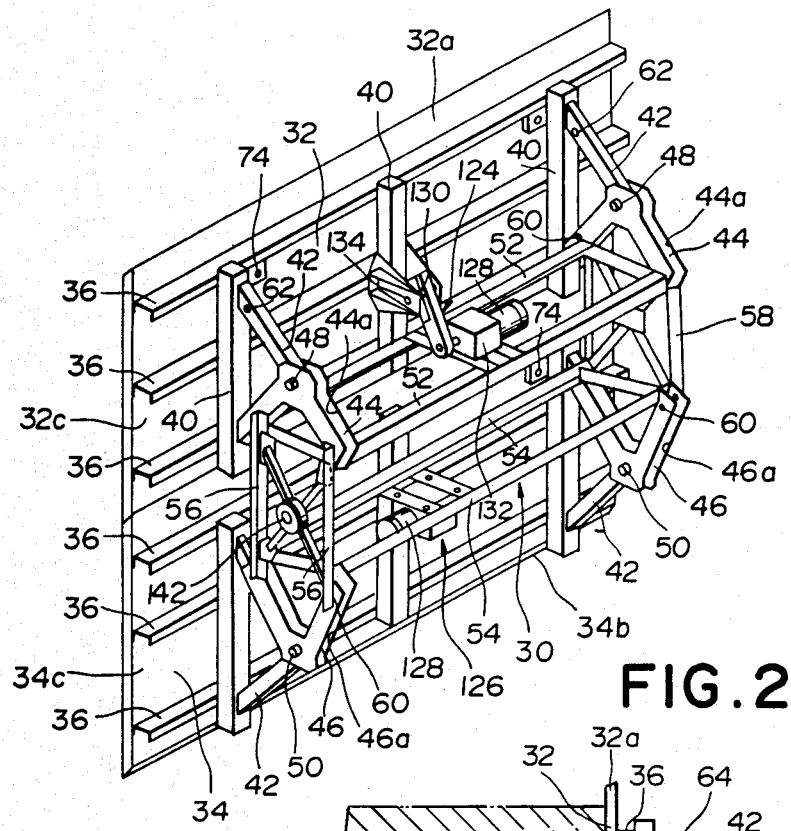
FIG. 1 is a perspective view of a formwork apparatus according to the present invention with its drive mechanisms omitted.

In the drawings, like reference characters designate corresponding parts throughout views, and descriptions of the corresponding parts are omitted after once given.

Figure 2:
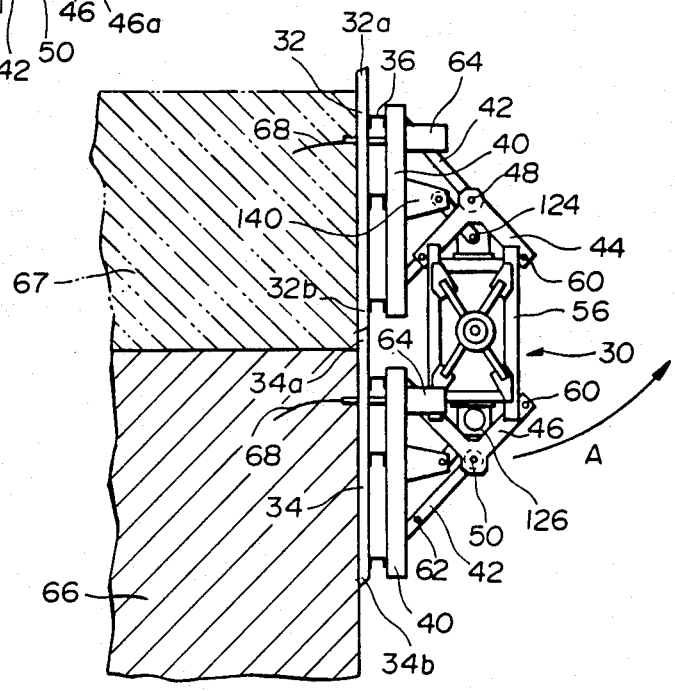
FIG. 2 is a side-elevational view of the form work apparatus in FIG. 1, showing its second form panel fixed to the cured concrete wall and its first form panel kept in a position upper side of the second form panel.

FIGS. 1 and 2 illustrate a formwork apparatus according to the present invention. In these drawings, the reference numeral 30 designates a center frame assembly, and the numerals 32 and 34 designate a pair of form panels, as first and second panels. Each of the panels 32 and 34 is a quadrangular shaped flat plate which has a plurality of horizontal wales 36 attached to its outer surface 38, which are parallel to its upper and lower edges, and a plurality of vertical wales 40 transversely attached to the horizontal wales 36. Each panel also has a pair of V-shaped supporting frames 42 and 42 attached at their ends to the vertical wales 40 which are located at opposite side edge portions of the panel respectively. At these supporting frames 42, the first and second panels 32 and 34 are pivotally connected to upper and lower ends 44 and 46 respectively of the frame assembly 30 so as to be pivoted about horizontal pivots 48 and 50 which are parallel to each other.

The center frame assembly 30 consists of four V-shaped joint brackets 44, 44, 46 and 46, four horizontal frames 52, 52, 54 and 54, and four vertical frames 56, 56, 58 and 58. The joint brackets 44 and 44 are connected at their corners to corners of the supporting frames 42 and 42 respectively of the first panel 32 by the pivots 48 and 48, and the joint brackets 46 and 46 are connected at their corners to corners of the supporting frames 42 and 42 of the second panel 34 respectively by the pivots 50 and 50. The horizontal frames 52 and 52 bridge the upper joint brackets 44 and 44, and the horizontal frames 54 and 54 bridge the lower joint brackets 46 and 46. The vertical frames 56 and 56 are attached at their opposite ends to the upper and lower joint bracket 44 and 46 which are on the left side in FIG. 1, and the vertical frames 58 and 58 are attached at their opposite ends to the upper and lower joint brackets 44 and 46 which are on the right side in FIG. 1. The joint brackets 44 and 46 are made of channel bars thus having grooves formed in them. The grooves 44*a* of the upper joint brackets 44 are open upwardly and the grooves 46*a* of the lower joint brackets 46 are open downwardly. These grooves 44*a* and 46*a* receive the respective supporting frames 42 of the first and second panels 32 and 34 when the panels 32 and 34 are pivoted to their respective positions, as shown in FIGS. 1 and 2, in which they are parallel to the vertical frames of the frame assembly 30. That is, the supporting frames 42 and the joint brackets 44 and 46 work as a limiting mechanism for limiting the pivoting motions of the panels 32 and 34 when the supporting frames 42 are received in the grooves 44*a* and 46*a*. Also, the joint brackets 44 and 46 have locking holes 60 penetrating themselves parallel to the horizontal frames, and locking pins (not shown) connected to themselves so as to axially slide along the holes 60. Each locking pin passes through the corresponding locking hole 60 and the corresponding supporting frame 42 at its engaging hole 62 to lock the corresponding panel to the frame assembly 30 when the supporting frame 42 is received in the corresponding groove.

Figure 3:
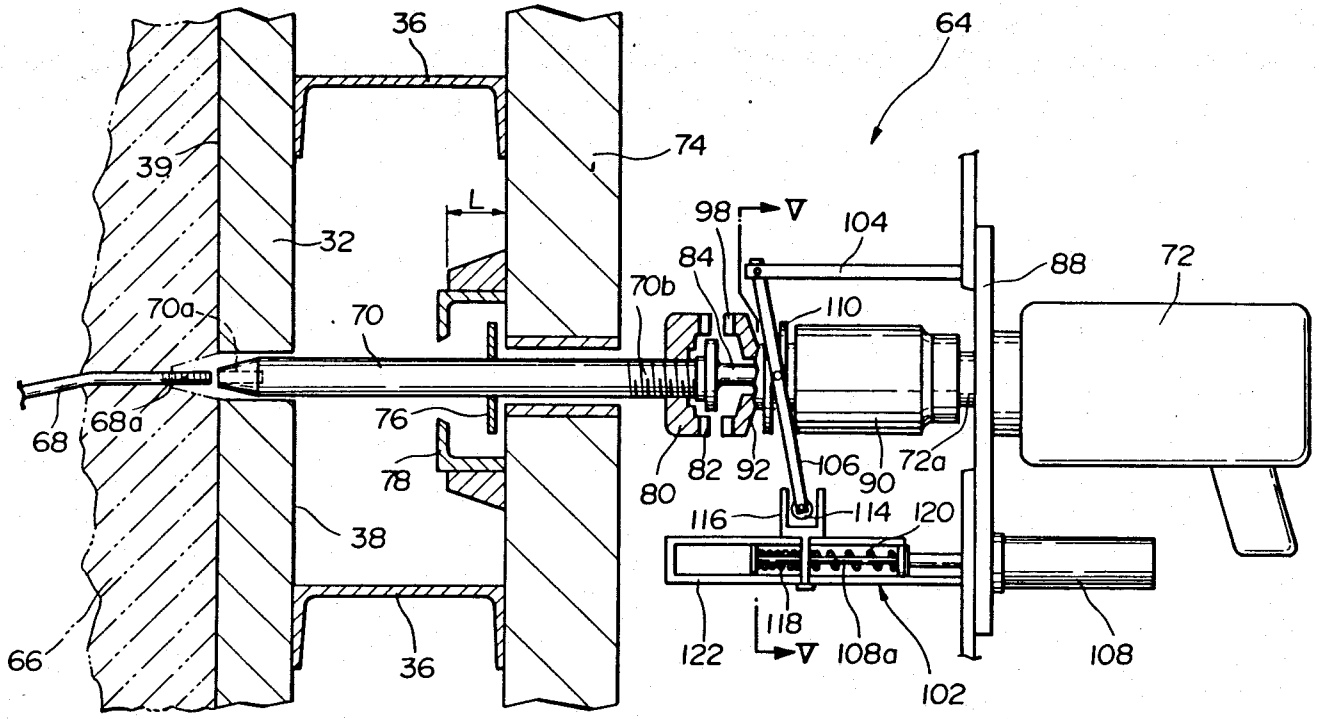
FIG. 3 is an enlarged side-elevational view, partly in cross section, of a fixing mechanism in FIG. 2 with its engaging bolt detached from its pigtail anchor.

In FIG. 2, each of the form panels 32 and 34 has a pair of fixing mechanisms 64 and 64 at its opposite side edge portions respectively for fixing and releasing the corresponding panel 32 or 34 to and from a cured concrete wall 66. FIG. 3 shows one of these fixing mechanisms 64 including a pigtail anchor 68, an engaging bolt 70, an electric torque wrench 72, and others which are described below. The engaging bolt 70 loosely passes through the corresponding form panel (the panel 32 in FIG. 3) and a support plate 74, which is attached to the horizontal wales 36, so as to axially slide and to rotate about its axis. The bolt 70 has a flange 76 circumferentially attached to its intermediate portion, and the support plate 74 has a stopper 78 attached to its inner face while surrounding the bolt 70. The flange 76 is positioned between the stopper 78 and the support plate 74 so that the range of sliding movement of the engaging bolt 70 is restricted within a length L. The bolt 70 also has a female screw portion 70*a* at its front end for threadedly engaging with the screw portion 68*a* of the pigtail anchor 68. A rear end portion 70*b* of the bolt 70 projects from an outer face of the support plate 74, and a nut 80 is threadedly engaged with this rear end portion 70*b*. The nut 80 has first teeth 82 peripherally formed on its rear face. Furthermore, the bolt 70 has an extension rod 84 coaxially joined at one end 84*a* thereof to the rear end 70*b* of the bolt 70. This extension rod 84 has first splines 86 mounted on the other end 84*b* thereof.

Figure 4:
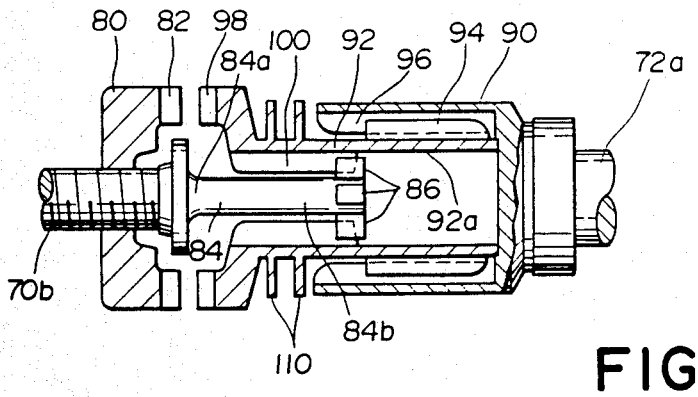
FIG. 4 is an enlarged cross-sectional view of a clutch assembly in FIG. 3 with first splines of its extension rod in engagement with second splines of its slider.

In FIG. 3, a mount bracket 88 is attached to the corresponding form panel. The electric torque wrench 72, as a drive motor, is secured to the mount bracket 88 with its drive shaft 72*a* concentrically positioned directly behind the engaging bolt 70. To the drive shaft 72*a* of the torque wrench 72, a sleeve 90 is coaxially attached. As shown in FIG. 4, a cylindrical slider 92 is coaxially connected inside the sleeve 90 by a spline connection (a connection between splines 94 and keyways 96) to be axially slidable while circumferentially surrounding the extension rod 84. The slider 92 has second teeth 98 circumferentially formed on its front end face facing to the nut 80. The slider 92 also has second splines 100 mounted on its inner face 92*a* to engage with the first splines 86 of the extension rod 84. These second splines 100 extend from the front end of the slider 92 to the substantially intermediate point of the slider so that they engage with the first splines 86 of the extension rod 84 when the slider is in its backmost position shown in FIG. 4 and they disengage from the first splines 86 when the slider 92 is moved forward to engage its second teeth 98 with the first teeth 82 of the nut 80.

Figure 5:
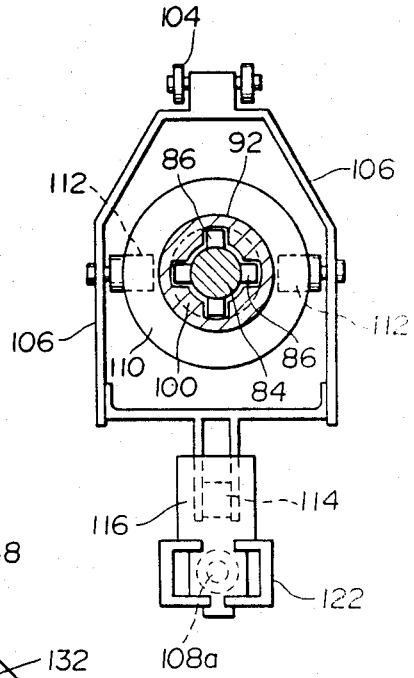
FIG. 5 is a view taken along the line V—V in FIG. 3.

As further shown in FIG. 3, the fixing mechanism 64 also includes a slider driving unit 102 for moving the slider 92 back and forth. This unit 102 includes a support arm 104 attached to the mount bracket 88 so as to extend forward from the mount bracket 88, a swing frame 106 pivotally connected at its upper end to a front end of the support arm 104, and an electric cylinder 108 secured to the mount bracket 88 for pivoting the swing frame 106. As shown in FIG. 5, the swing frame 106 surrounds the slider 92 and engages with the same. This engagement is accomplished by a pair of engaging flanges 110 and 110 circumferentially mounted on an outer face 92*b* of the slider 92 at an axial spacing and a pair of rollers 112 and 112 received between the flanges 110 while rotatably attached to the swing frame 106. The swing frame 106 has another roller 114 rotatably connected to its lower end, and this roller 114 is engaged with a sliding plate 116. A piston rod 108*a* of the electric cylinder 108 extending forward from the bracket 88 freely passes through the sliding plate 116 and is connected via springs 118 and 120 with the plate 116 (see FIG. 3). In addition, the reference numeral 122 designates a guide rail which guides the piston rod 108*a* axially.

With the arrangement of the fixing mechanism 64, operations for fixing the corresponding form panel 32 or 34 to the concrete wall should be carried out as follows.

At first, the slider 92 is moved into its backmost position and the pigtail anchor 68 is manually held so that its screw portion 68*a* faces to the front end 70*a* of the engaging bolt 70. Next, the electric wrench 72 is turned on to rotate the bolt 70 so that the anchor 68 is threadedly attached to the front end 70*a* of the bolt 70. After the anchor 68 is attached, the electric cylinder 108 is operated to move the slider 92 forward, thus the second teeth 98 is engaged with the first teeth 82 of the nut 80. Meanwhile, the slider 92 pushes the nut 80 causing the bolt 70 to slide forward until the flange 76 is brought into contact with the stopper 78. In this front position, the bolt 70 is biased forward by the spring 120. The concrete is then poured and placed inside the corresponding form panel, causing the anchor 68 to be embedded in the concrete as illustrated by phantom lines in FIG. 3. After the concrete is cured, the electric wrench 72 is turned on this time to rotate the nut 80, and the nut 80 is tightened in order to firmly secure the panel to the cured concrete wall 66.

On the other hand, in order to release the panel from the concrete wall, the slider 92 is kept in its front position, and then the nut 80 is rotated in a reverse direction to be untightened. After that, the slider 92 is moved backward into its backmost position by retracting the piston rod 108*a* of the electric cylinder 188, and then the bolt 70 is reversely rotated until it is detached from the anchor 68.

The slider 92 may be directly connected to the drive shaft 72*a* of the wrench 72 by a spline connection instead of interposing the sleeve 90 between the shaft 72*a* and the slider 92. In place of the slider driving unit 102 shown in FIG. 3, a unit including a wire which connects the piston rod 108*a* of the electric cylinder 108 with the lower end of the swing frame 106, and a spring which connects the lower end of the swing frame 106 with the support plate 74 may be employed.

Figure 6:
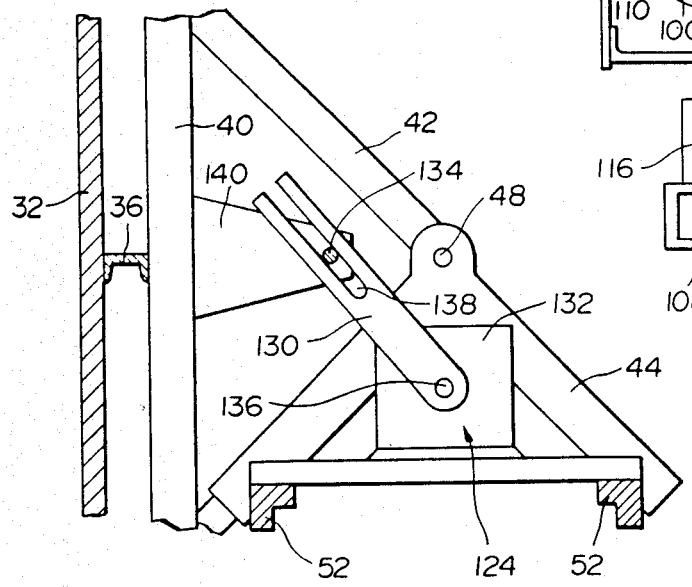
FIG. 6 is an enlarged side-elevational view of a drive mechanism in FIG. 1.

Returning to FIG. 1, a first drive mechanism 124 is arranged between the first form panel 32 and the frame assembly 30, and a second drive mechanism 126 is arranged between the second form panel 32 and the frame assembly 30. Each of the drive mechanisms 124 and 126 includes an electric motor 128 secured to the corresponding horizontal frame 52 or 54 of the frame assembly, a drive arm 130 connected at one end 130*a* thereof via a speed reducer 132 to the drive shaft (not shown) of the motor 128, and a sliding pin 134 connecting the other end 130*b* of the drive arm 130 to the corresponding panel 32 or 34. As shown in FIG. 6, the drive arm 130 has a through slot 138 formed in it to longitudinally extend. The sliding pin 134 passes through the slot 138 loosely and attached at its opposite ends via a bracket 140 to the center vertical wale 40 of the corresponding form panel. When the electric motor 128 is turned on, the drive arm 130 is rotated about the shaft 136 which is parallel to the pivots 48 and 50. Then, the corresponding panel is pivoted about the corresponding pivot 48 or 50, while the sliding pin 134 slides along the through slot 138. In addition, reference numeral 142 in FIG. 1 designates a slip ring attached to the vertical frames 56 of the frame assembly 30. This slip ring 142 is facilitated for connecting the electric motor 128, the torque wrench 72 and the electric cylinder 108 to a electric power source (not shown) that is outside the apparatus.

When a concrete wall of a dam is built, the formwork apparatus of the aforementioned construction is operated as follows.

Firstly, as illustrated in FIG. 2, the second form panel 34 is secured to a hardened concrete wall 66 by its fixing mechanisms 64 and 64, and the first form panel 32 is arranged in a position upper side of the second panel 34 in which the lower edge 32*b* of the first panel 32 is in contact with the upper edge 34*a* of the second form panel 34. In this position, the inner surfaces 39 of the first form panels 32 and an upper part of the second panel's inner surface 39 form a sequential vertical surface for molding. Also, the form panels 32 and 34 are locked to the center frame assembly 30 by using the locking holes 60, engaging holes 62 and locking pins so that they do not pivot.

Secondly, as illustrated by the phantom lines in FIG. 2, concrete is poured and placed inside the first form panel 32.

Figure 7:
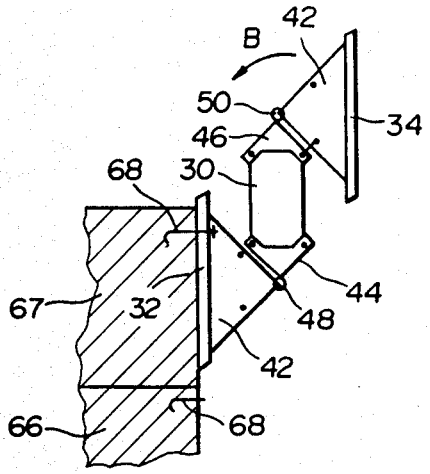
FIG. 7 is a schematic side-elevational view of the formwork apparatus in FIG. 2, showing the first panel fixed to the concrete wall and the second panel pivoted upwards.

Thirdly, after the poured concrete is cured, the first form panel 32 is firmly secured to the cured concrete wall 67 by tightening the nuts 80 of its fixing mechanisms 64 and 64. Then, the second form panel 34 is released from the concrete wall 66 and the first form panel 32 is unlocked from the frame assembly 30. Thereafter, by operating the first drive mechanism 124, the frame assembly 30 is pivoted 180° in a direction indicated by the arrow A in FIG. 2 around the first panel 32, and thus lifted in a position shown in FIG. 7.

Figure 8:
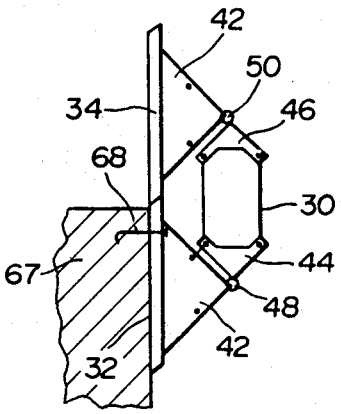
FIG. 8 is a schematic side-elevational view of the formwork apparatus in FIG. 2, showing the second form panel raised in a position upper side of the first panel.

Fourthly, the frame assembly 30 is locked to the first form panel 32, and the second form plate 34 is unlocked from the frame assembly 30. After that, by operating the second drive mechanism 126, the second form panel 34 is pivoted in a direction indicated by the arrow B in FIG. 7 about the pivot 50, therefore replaced in a position upper side the first panel 32 as shown in FIG. 8.

Fifthly, the second form panel 34 is locked to the frame assembly 30, and then concrete is poured inside the second form panel 34 for performing the second concrete placing. Again, the formwork apparatus is then operated in the same manner.

Accordingly, in using this apparatus, cranes are not necessary since the first and second panels 32 and 34 are alternately fixed to the concrete wall and the replacement of the form panels can be accomplished automatically by sequentially operating each mechanism of the apparatus. Also, it is possible for this apparatus to construct a curved concrete wall by setting the angle between the first and second form panels 32 and 34 excluding an angle of 180°.

Figure 9:
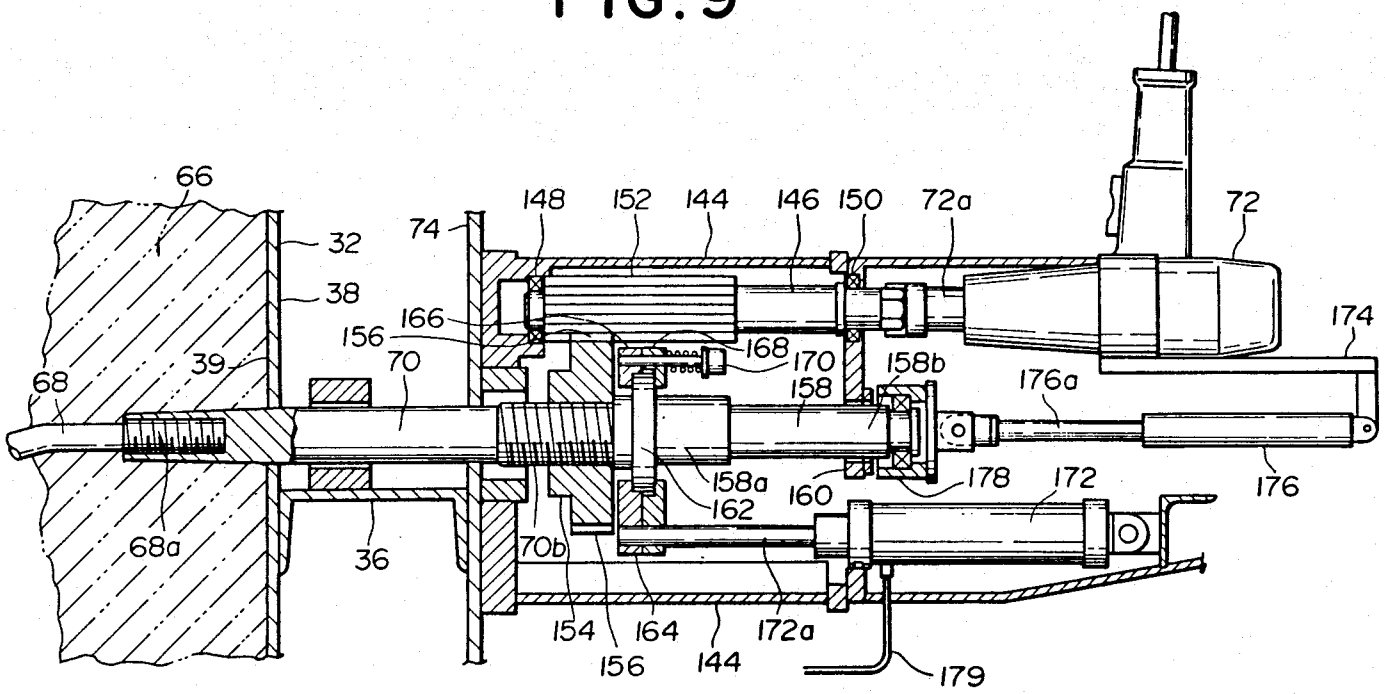
FIG. 9 is an enlarged cross-sectional view of a modified form of the fixing mechanism in FIG. 3.

A modified form of the fixing mechanism 64 in FIG. 3 is shown in FIG. 9, in which a housing 144 is attached to the support plate 74 for receiving the parts of the mechanism 64. A connecting shaft 146 is coaxially joined to the drive shaft 72*a* of the electric torque wrench 72 which is secured to the housing 144 at a position behind the bolt 70, and it extends forward with its opposite ends supported by ballbearings 148 and 150. This connecting shaft 146 has axially elongated third teeth 152 circumferentially formed on it. A circular nut 154 having fourth teeth 156 circumferentially formed on its circumferential face is threadedly engaged with the rear end portion 70b of the bolt 70. The fourth teeth 156 of the nut 154 are engaged with the third teeth 152 of the connecting shaft 146 so that the nut 154 slides along the connecting shaft 146. A rod piece 158 is coaxially joined to the rear end 70b of the bolt 70. The front end portion 158a of the rod piece 158 has a larger diameter than the rear end portion of the bolt 70 so that the nut 154 is prevented from rotating about the bolt 70, that is, the nut 154 is secured to the bolt 70 when the nut 154 is brought into contact with the rod piece 158. When the bolt 70 is moved backward, this front end portion 158a contacts with a bushing 160 which rotatably supports the rear end portion 158b of the rod piece 158, thereby restricting the range of sliding movement of the bolt 70.

The rod piece 158 has a brake flange 162 circumferentially mounted on the front end portion 158a of the rod piece 158. The flange 162 is held by a clamp 164. This clamp 164 includes a pair of annular holding plates 166 and 168 in contact with the opposite faces of the flange 162, and a spring assembly 170 fastening the annular plates to each other with a predetermined clamping force. An air cylinder 172 as a bolt retracting means which is connected to the housing 144 is attached at its piston rod 172a to the annular plates 166 and 168 so that the clamp 164 can move back and forth. These flange 162 and the clump 164 constitutes a braking mechanism which prevents the bolt 70 from rotating as long as the bolt 70 undergoes a torque less than predetermined one.

A stay 174 is attached to the housing 144, and a biasing cylinder 176 is pivotally connected at its rear end to the stay 176. The piston rod 176a of the biasing cylinder 176 is connected via a journal box 178 to the rear end 158a of the rod piece 158. The biasing cylinder 176 has a coil spring inside, thus biasing the rod piece 158, that is, the bolt 70 forward.

With the fixing mechanism of this modification, operations for panel fixing are carried out as follows.

At first, the pig tail anchor 68 is manually screwed into the front end portion 70a of the bolt 70, while the front end portion 70a projects from the inner surface 39 of the panel. During this screwing operation, the braking mechanism prevents the bolt 70 from being rotated, therefore the nut 154 is not tightened. Next, the concrete placing is performed inside the panel 32 to construct the concrete wall 66. During this concrete placing, the biasing cylinder 176 prevents the bolt 80 from being pushed out of the concrete wall 66 by concrete compression. After the concrete is hardened, the electric wrench 72 is turned on to rotate and to tighten the nut 154, thus the panel 32 is firmly fixed to the cured concrete wall 66.

On the other hand, in order to release the panel from the concrete wall, the air cylinder 172 is supplied with compressed air through a flexible pipe 179, thereby biasing the bolt 70 backward against the biasing force of the biasing cylinder 176. Then, the electric wrench 72 is turned on, this time to reversely rotate and to loosen the nut 154. The loosen nut 154 is continuously rotated and moved backward. Then, the nut 154 is brought into contact with the front end portion 158a of the rod piece 158 thereby secured to the bolt 70, which causes the torque of the wrench 72 to be transmitted via the nut 154 to the bolt. Therefore, the bolt 70 is rotated in order to be unscrewed from the anchor 68. After the bolt 60 is detached, the bolt 60 is moved into its backmost position by the biasing force of the air cylinder 172.

Figure 12:
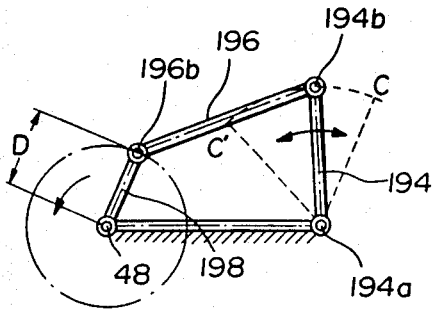
FIG. 12 is a view of a conceptual model of a crank assembly in FIG. 10.
Figure 11:
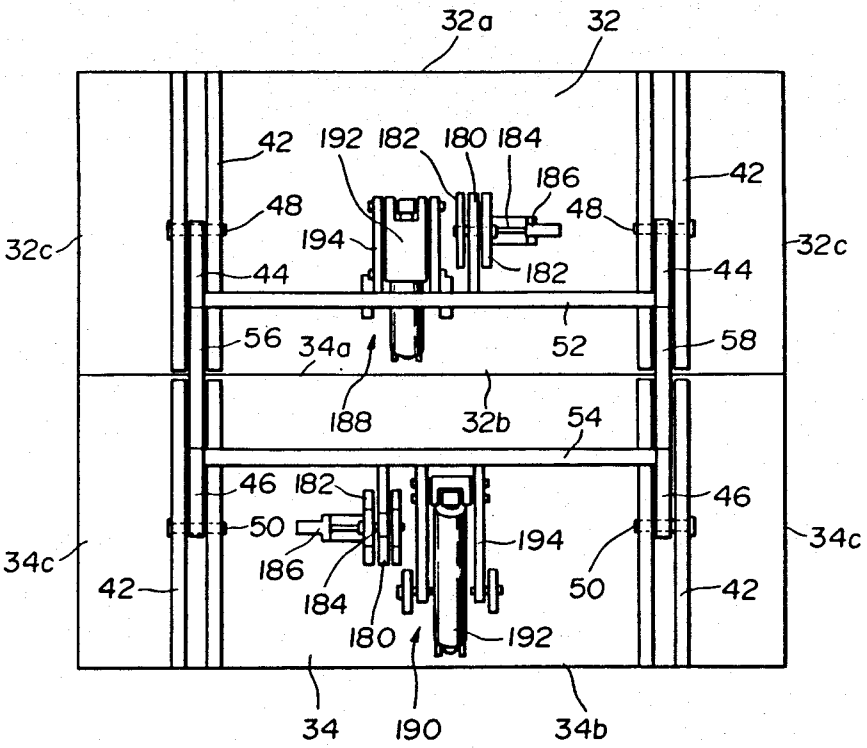
FIG. 11 is a front view of the formwork apparatus in FIG. 10.
Figure 10:
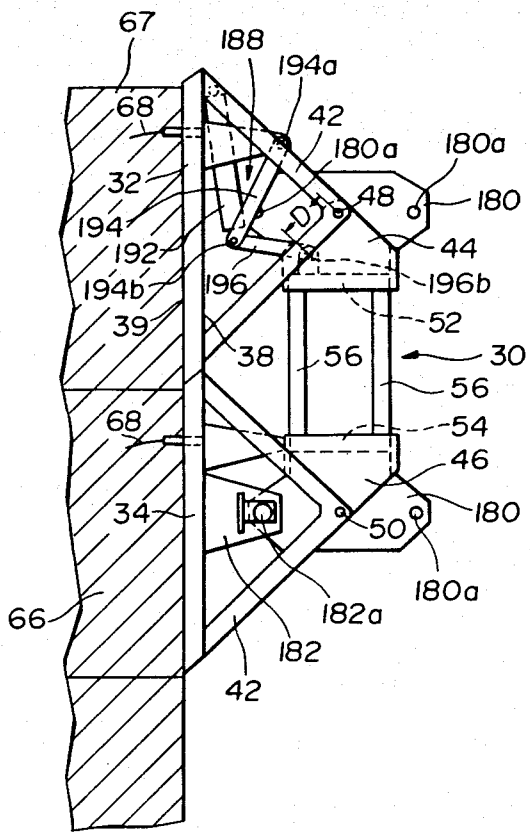
FIG. 10 is a side-elevational view of another embodiment according to the present invention.

FIGS. 10 to 12 illustrate another embodiment of the present invention, in which the frame assembly 30 has a pair of locking plate pieces 180 and 180 perpendicularly attached to its upper and lower horizontal frames 52 and 54 respectively. Each locking piece 180 has through holes 180a formed in it. A pair of parallel engaging plate pieces 182 and 182 are attached to the outer surface 38 of each form panel 32 or 34 parallel to the locking plate piece 180. These engaging pieces 182 also have concentric through holes 182a. As shown in FIG. 11, a locking pin 184 is mounted on each form panel so as to be disposed along an axis of the through holes 182 and to be axially slidable. A cylinder 186 is connected to the locking pin 184 to axially slide the pin 184. The engaging pieces 182 receive the corresponding locking piece 180 between themselves with their through holes 182a concentric with the hole 180a when the corresponding form panel is pivoted to a position in which the form panel is parallel to the vertical frames of the frame assembly 30. Then, the locking pin 184 is axially moved and passes through both the through hole 180a of the locking piece 180 and the through holes 182a of the engaging piece 182 in order to lock the corresponding form panel to the frame assembly 30. In order to unlock the panel from the frame assembly 30, the locking pin 184 is withdrawn from the holes 180a and 182a.

Returning to FIG. 10, drive mechanisms 188 and 190 are arranged between the frame assembly 30 and the panels. Each of the drive mechanisms 188 and 190 includes a hydraulic cylinder 192 as a cylinder actuator, pivotally connected at one end thereof to the corresponding panel, and a crank assembly. This crank assembly includes a swing arm 194 pivotally connected at one end 194a thereof to the corresponding form panel and at the other end 194b to the other end of the hydraulic cylinder 192, and a connecting arm 196 pivotally connected at one end thereof to the other end of the swing arm 194b and at the other end 196b to the corresponding upper or lower horizontal frame 52 or 54. As shown in FIG. 10, the other end 196b of the connecting arm 196 is connected to a point spaced from the corresponding pivot which connects the corresponding panel with the joint bracket. The distance D between the point and the corresponding pivot 48 or 50 is smaller than the length of the swing arm 194. When the hydraulic cylinder 192 is operated, the swing arm 194 is pivoted back and forth between positions shown by the chain lines C and C' in FIG. 12 which is a conceptual model of the crank assembly. Then, the connecting arm 196 is reciprocated substantially in its longitudinal direction, causing the a crank 198, i.e., the frame assembly 30 to rotate about the corresponding pivot 48 or 50.

Figure 15:
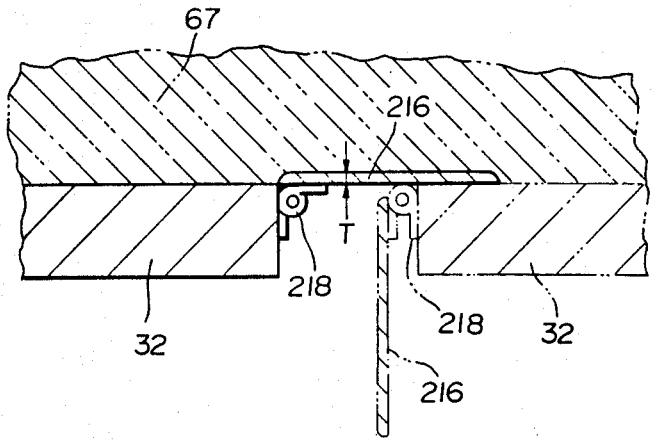
FIG. 15 is a view taken along the line XV—XV in FIG. 14.
Figure 14:
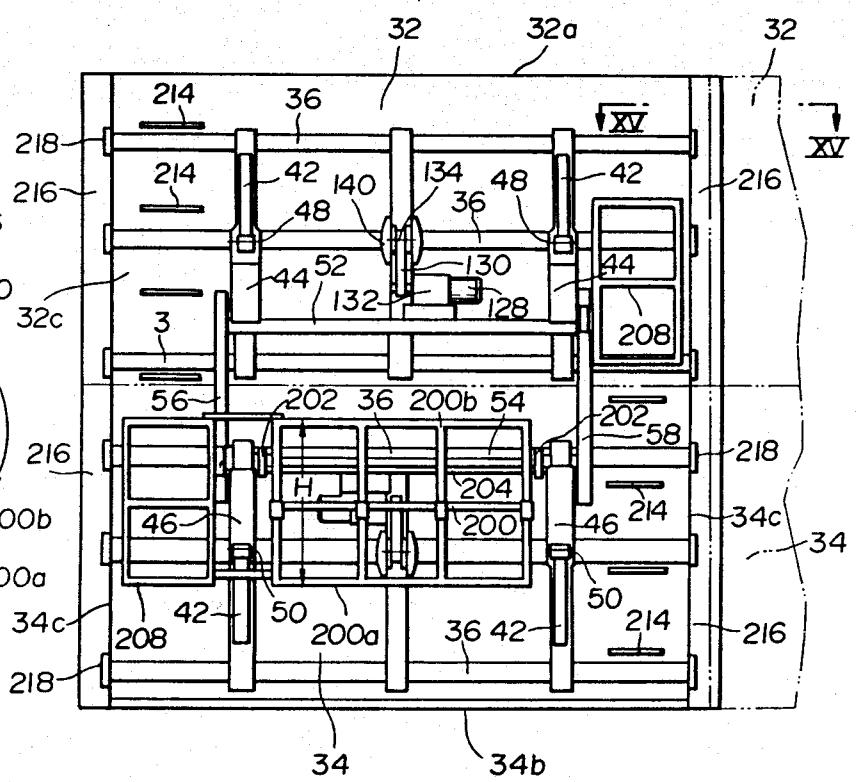
FIG. 14 is a front view of the formwork apparatus in FIG. 13.
Figure 13:
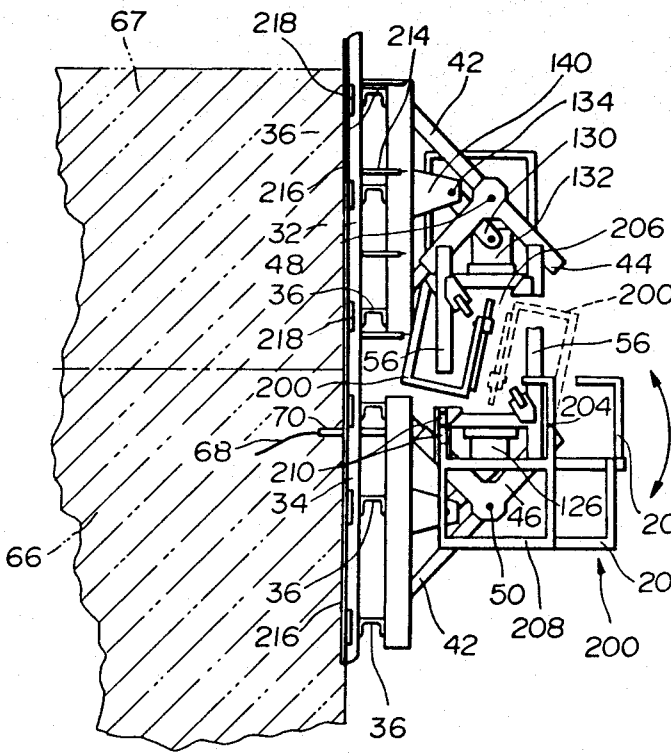
FIG. 13 is a side-elevational view of a further embodiment according to the present invention with one of its scaffold taken out of a docking space of its frame assembly.

FIGS. 13 to 15 show a further embodiment of the present invention, in which the frame assembly 30 has a pair of scaffolds 200 and 200 connected to the upper and lower horizontal frames 52 and 54 respectively. As shown in FIG. 14, each horizontal frame 52 or 54 has brackets 202 supporting a pivot 204 parallel to the horizontal frame. The scaffold 200 consists of a lower stage portion 200a connected to the pivot 204 so as to be pivoted upward and down ward, and an upper handrail portion 200b slidably connected to the stage portion 200a for upward and downward movement. In other words, the scaffold can expand and contract its vertical length H, thus enabling itself to be received in a docking space 206 defined in the frame assembly 30 when contracted. An auxiliary scaffold 208 is also connected to the pivot 204 at a position beside the scaffold 200. As shown in FIG. 13, each of these scaffold 200 and the auxiliary scaffold 208 has a plurality of engaging holes 210 which is to engage with an angle adjusting pin (not shown) mounted on the frame assembly 30 for adjusting an angle of the scaffold relative to the frame assembly 30. In addition, the reference numeral 214 designates a step for workers.

When the frame assembly 30 is pivoted around one of the form panels 32 and 34 for their replacement, the scaffold 200 is kept in the docking space 206 so that it does not project outwards from the frame assembly 30. As a result, the scaffold 200 does not block the rotary motion of the frame assembly 30. On the other hand, the scaffold 200 is taken out of the docking space 206 when it is necessary. The putting in and taking out operation of the scaffold 200 is performed by workers. For example, the workers step down onto the auxiliary scaffold 208 by using steps 214, and pivot the scaffold 200 in order to either take it out of or put it into the space 206. The angle of the scaffold 200 relative to the frame assembly 30 is adjusted so that the bottom plate of the stage portion 200*a* is brought to a horizontal level when the form panel is inclined relative to a vertical line.

As further illustrated in FIG. 14, each of the form panels 32 and 34 has a pair of elongated joining plates 216 connected parallel to its opposite side edges 32*c* or 34*c* by hinges 218. As shown in FIG. 15, the thickness T of each joining plate 216 is much thinner than that of each form plate. For example, the thickness T is in a range of 0.5 mm to 2.0 mm. When concrete placing is performed with a plurality of the formwork apparatuses of this embodiment, an apparatus with its joining plates 216 open as shown by the solid line in FIG. 15 and an apparatus with its joining plate closed as shown by the phantom line are alternately aligned horizontally with the side edge portions of an apparatus placed on the joining plates 216 of the adjacent apparatus as shown in FIG. 14. As a result, during the concrete placing, it is possible by using the joining plates 216, since the joining plates 216 eliminate gaps between these apparatuses, to leave the wide gaps between them without concrete leaking from the gaps, thereby avoiding collision between the apparatuses. After the concrete is cured, first the apparatuses with their joining plates 216 closed are replaced, and secondly the apparatuses with their joining plates 216 opened are replaced.

The scaffold 200 may be pivoted about a substantially vertical axis in stead of being pivoted about a horizontal axis. The scaffold 200 and the joining plates may be automatically operated by providing them with actuators and control equipments. Moreover, the joining plates 216 may be magnetized or may be provided with magnets in order to magnetically fasten it to the panels which overlap it. One joining plate 216 may be attached to one of the opposite side edges of each panel in stead of attaching two joining plates. Also, an additional joining plate may be attached parallel to one of the upper and lower edges of each panel in order to eliminate a gap between the first and second form panels, when one of the form panels is positioned at the upper side of the other form panel.

Figure 16:
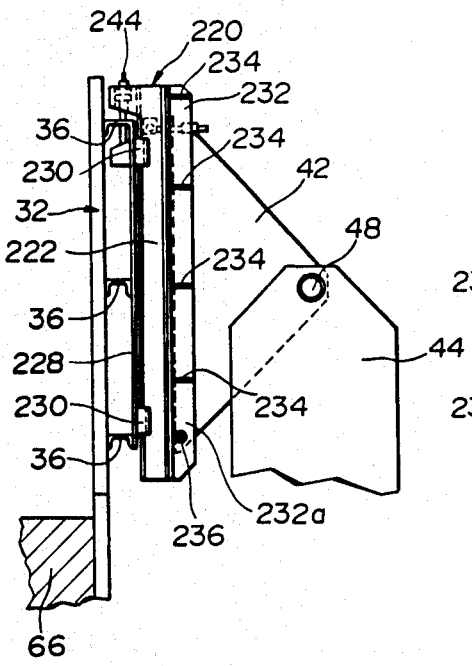
FIG. 16 is a side-elevational view of a still further embodiment according to the present invention with its second form panel and frame assembly omitted.
Figure 17:
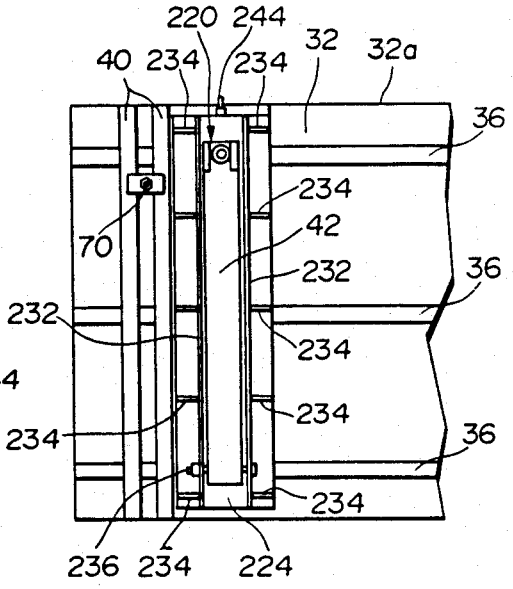
FIG. 17 is a front view, partially cutaway, of the first panel in FIG. 16.

A still further embodiment of the present invention is illustrated in FIGS. 16 to 24, in which each of the form panels 32 and 34 has a mechanism for bringing its upper edge to a horizontal level so that its fixing position is corrected. As shown in FIGS. 16 and 17, this position correcting mechanism has a pair of vertically elongated guide frames 220 interposed between the corresponding form panel (the first panel 32 in the drawings) and the supporting frames 42. Each of the guide frames 220 includes a pair of side plates 222 (see FIG. 19) disposed parallel to each other, a main plate 224 bridging rear edges of the side plates 222, and a pair of wing plates 226 longitudinally welded to the side plates 222 respectively so as to project sideward. The form panel 32 has a pair of elongated bracket plates 228 virtically attached to the opposite side edge portions 32*c* of the form panel 32 respectively, and each of the bracket plates 228 loosely holds the wing plates 226 of the guide frame 220 with a pair of holder 230 attached to the opposite ends of the bracket plate 228. A large clearance, for example a clearance of several millimeters, is left between the wing plates 226 and the holder 230. In other words, the form panel 32 is connected at its opposite side edge portions 32*c* to the guide frames 220 so as to be movable not only upward and downward but also slightly sideward.

The guide frame 220 also includes a pair of connecting plates 232 longitudinally welded to the main plate 224 so as to project backward with a transverse spacing therebetween. These connecting plates 232 are reinforced by a plurality of ribs 234 vertically aligned at spaces apart. As illustrated in FIG. 16, the guide frame 220 is pivotally connected at the lower ends 232*a* of its connecting plates 232 to one of the supporting frames 42 of the panel 32 by a pivot 236 which is parallel to the pivots 48 and 50.

Figure 18:
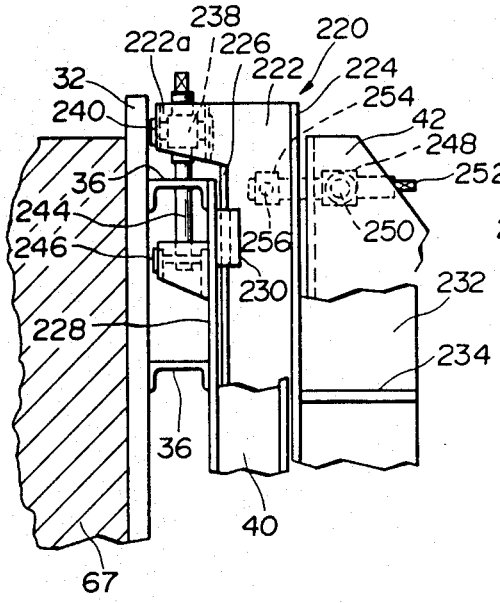
FIG. 18 is an enlarged side-elevational view of a position correcting mechanism in FIG. 16.
Figure 19:
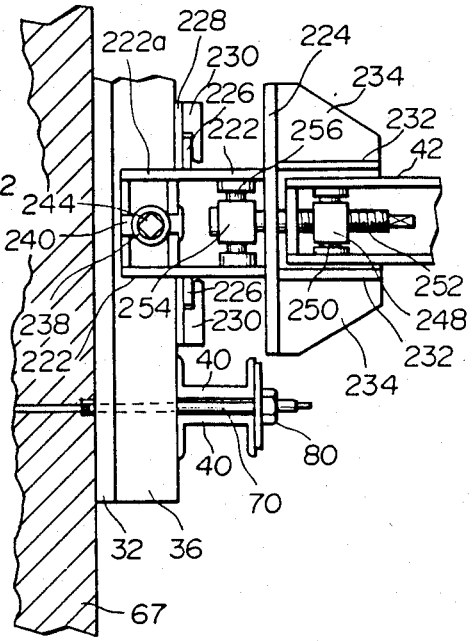
FIG. 19 is a plan view of the position correcting mechanism in FIG. 18.

As shown in FIG. 18, the side plates 222 of the guide frame 220 have upper end portions 222*a* projecting toward the panel 32. To these upper end portions 222*a*, a first tube piece 238 is connected via a pin 240 which is perpendicular to the form panel 32. A first screw rod 244 is threadedly engaged at its upper end portion with the first tube piece 238. This first screw rod 244 has a lower end portion which can rotate about its axis relative to the upper end portion, and this lower end portion of the first screw rod 244 is connected to a pin 246 which is perpendicularly attached to the bracket plate 228.

Also, a second tube piece 248 is connected via a pin 250 to an upper end of the supporting frame 42. The pin 250 is parallel to the pivot 236. A second screw rod 252 is threadedly engaged at its rear end portion with the second tube piece 248 and is also connected at its front end portion with a third tube piece 254 which loosely fits around the second screw rod 252 so that the rod 252 can rotate about its axis. This third tube piece 254 is connected via a pin 256, which is parallel to the pin 250, to the side plates 222 of the guide frame 220.

Figure 20:
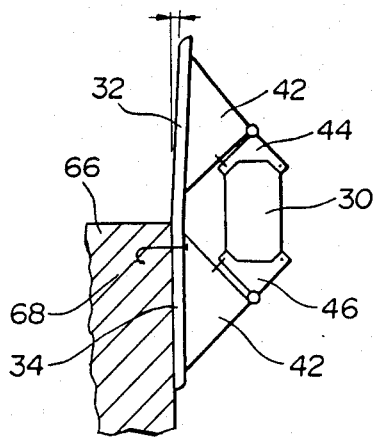
FIG. 20 is a schematic side-elevational view of the formwork apparatus in FIG. 16 with the first panel inclining relative to a vertical line.

When the first or second form panel 32 or 34 inclines relative to a vertical line as illustrated in FIG. 20, the second screw rod 252 is manually turned about its axis (for example, by using a ratchet wrench) so that the guide frame 220 is pivoted forward. Thereby, the inclination is dissipated.

Figure 21:
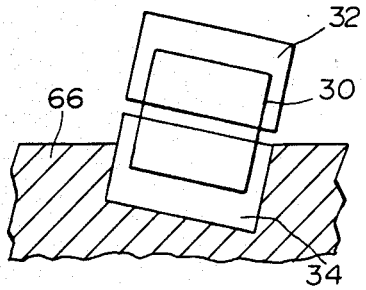
FIG. 21 is a schematic front view of the formwork apparatus in FIG. 20 with an upper edge of the first and second panel inclining relative to a horizontal line.
Figure 22:
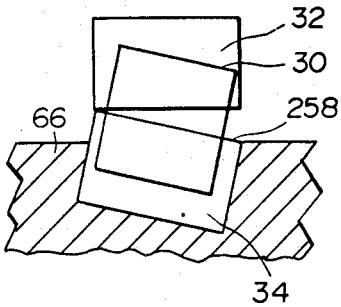
FIG. 22 is a schematic front view of the apparatus in FIG. 21 with the upper edge of the first panel brought to a horizontal level.
Figure 23:
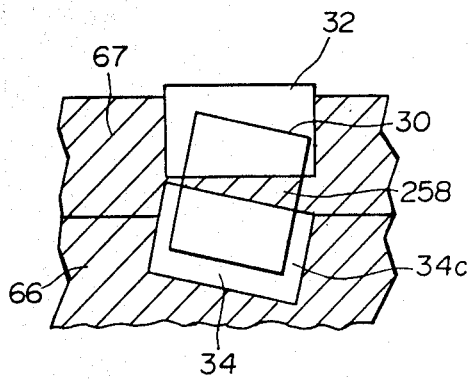
FIG. 23 is a schematic front view of the apparatus in FIG. 22, showing concrete placing performed inside the first panel.
Figure 24:
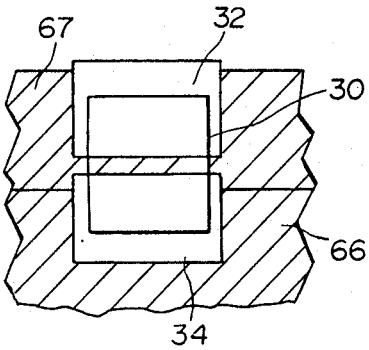
FIG. 24 is a schematic front view of the apparatus in FIG. 23 with an upper edge of the second panel brought to a horizontal level.

On the other hand, when the upper edge of the first or second form panel 32 or 34 inclines relative to a horizontal line as shown in FIG. 21, one or both of the first screw rods 244 is manually turned about its axis so that the upper edge of the form panel is brought to a horizontal level. After the fixing position of the panel is corrected as shown in FIG. 22, the concrete placing is performed inside the panel 32 as shown in FIG. 23. A filler such as putty is stuffed in a gap 258 between the first and second form panels 32 and 34 in order to prevent the concrete from leaking. After the concrete is cured, the lower panel 34 is released from the concrete wall, and then the same first screw rod or rods 244 is turned, this time in the reverse direction in order to move the right side edge portion 34*c* of the lower panel 34 upwards (see FIG. 24).

The first and second screw rods 244 and 252 may be provided with electric or hydraulic actuators which drive them. These actuators may have sensors detecting for inclinations of the panels 32 and 34 relative to horizontal and vertical lines in order to automatically self-start. Furthermore, jack devices other than the jack-screw may be employed in place of the first and second screw rods.

Figure 25:
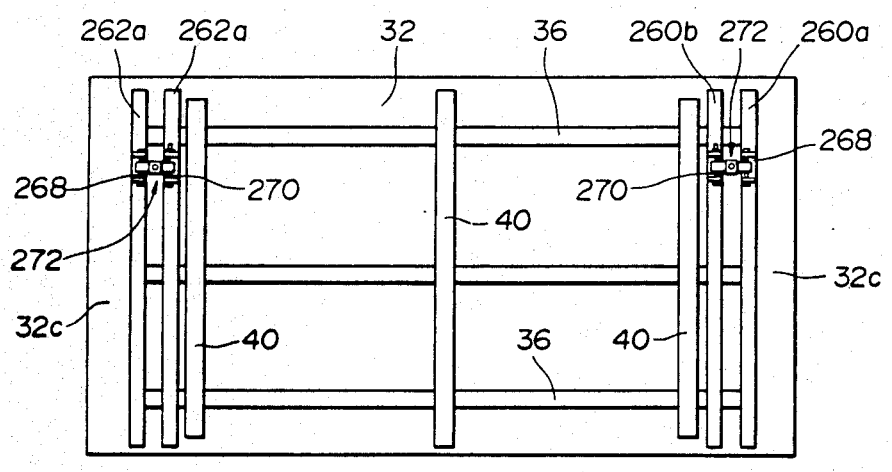
FIG. 25 is a front view of a formwork apparatus which has a modified form of the position correcting mechanism in FIG. 16.
Figure 26:
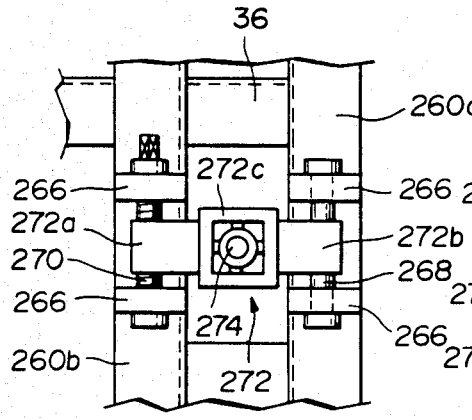
FIG. 26 is an enlarged front view of a position correcting mechanism in FIG. 25.
Figure 27:
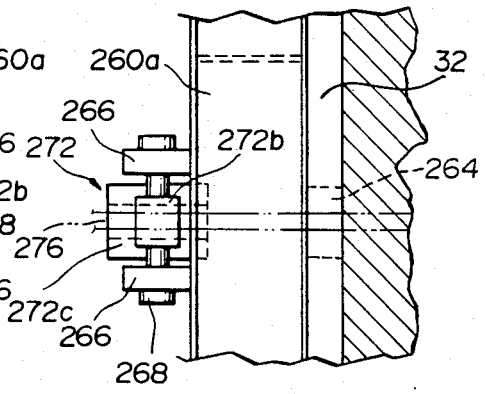
FIG. 27 is a side-elevational view of the position correcting mechanism in FIG. 26.

FIGS. 25 to 27 illustrate a modified form of the position correcting mechanism in FIGS. 16 to 24, in which each form panel (the first panel 32 in the drawings) has two pairs of vertical wales 260*a*, 260*b*, 262*a*, and 262*b* welded by their respective pairs on the opposite side edge portions 32*c* and 32*c* of the panel 32. As shown in FIG. 27, an elongated through hole 264 is formed in each of the side edge portions 32*c* of the form panel 32 so as to extend along the side edge of the form panel 32. The exact position of the elongated through hole 264 is between a pair of the vertical wales (wales 260*a* and 260*b* in FIGS. 26 and 27) and within the vicinity of the upper edge 32*a* of the panel 32. Each of the vertical wales has a pair of support brackets 266 mounted on it at vertical spacing. The upper support bracket 266 is located at a slightly higher level than the upper end of the elongated hole 264, and the lower support bracket is located at a slightly lower level then the lower end of the hole 264. A guide bar 268 is attached at its opposite ends to the upper and lower brackets 266 of one of the vertical wales 260*a* and 260*b*, and a screw bolt 270 as adjusting means, is loosely holded at its opposite ends by the upper and lower bracket 266 of the other vertical wale. A transversely elongated mobile block 272 is threadedly engaged at one end 272*a* thereof with the screw bolt 270, and the other end thereof 272*b* loosely fits around the guide bar 268 so that the mobile block 272 can slide along the bar 268. This mobile block 272 has a bolt guide portion 272*c* at its substantially intermediate point, which has a bolt guide hole 274 penetrating the bolt guide portion 272*c* in a direction perpendicular to the panel 32. An anchor bolt 276 passes through both the bolt guide hole 274 and the elongated hole 264 in order to fix the form panel 32 to the concrete wall.

In this arrangement, a pair of the anchor bolts 276 projecting from the inner face of the panel 32 are embedded in a concrete wall, thus the panel 32 is attached to the wall. When the upper edge 32*a* of the attached panel is inclined in relation to a horizontal line, the screw bolts 270 are turned so that a side edge portion 32*c* of the panel 32 that is lower than the other side edge portion 32*c* is moved upwards or the other side edge portion 32*c* is guided downwards.

It is understood that although preferred embodiments of the present invention have been shown and described, various modifications thereof will be apparent to those skilled in the art, and, accordingly, the scope of the present invention should be defined only by the appended claims and equivalents thereof.

What is claimed is:

1. A formwork apparatus for concrete placing comprising:

a center frame assembly having upper and lower ends;

first and second form panels for molding concrete walls, each having a supporting member mounted on an outer surface thereof, the first form panel pivotally connected at the supporting member thereof to the upper end of the frame assembly so as to be pivoted about a substantially horizontal axis, the second form panel pivotally connected at the supporting member thereof to the lower end of the frame assembly so as to be pivoted about an axis parallel to a pivot connecting the first panel with the frame assembly;

first fixing means for fixing and releasing the first panel to and from a concrete wall;

second fixing means for fixing and releasing the second panel to and from the concrete wall;

first drive means for pivoting the frame assembly around the first panel when the first panel is fixed to the concrete wall so that the second panel is lifted to a position upper side of the first panel; and second drive means for pivoting the frame assembly around the second panel when the second panel is fixed to the concrete wall so that the first panel is lifted to a position upper side of the second panel.

2. A formwork apparatus according to claim 1, further comprising first locking means for locking and unlocking the first panel to and from the frame assembly so that the first panel is not pivoted while locked, and second locking means for locking and unlocking the second panel to and from the frame assembly so that the second panel is not pivoted while locked.

3. A formwork apparatus according to claim 2, wherein each of the first and second locking means comprises a locking pin slidably mounted on the frame assembly or on the corresponding form panel, the locking pin passing through both the frame assembly and the supporting member of the form panel when axially slid.

4. A formwork apparatus according to claim 2, wherein each of the first and second locking means comprises: a locking plate piece attached to the frame assembly; an engaging plate piece attached to the outer surface of the corresponding form panelso as to be parallel to the locking plate piece, the engaging piece overlapping the locking piece when the frame assembly is pivoted to a desired position; and a locking pin slidably mounted on the frame assembly or on the form panel, the locking pin passing through both the engaging piece and the overlapped locking piece when axially slid.

5. A formwork apparatus according to claim 1, wherein each of the first and second panels has a substantially quadrangular shape, the first panel and an upper edge portion of the second panel forming a sequential inner surface for molding when a lower edge of the first panel is brought into contact with the upper edge of the second panel, the second panel and an upper edge portion of the first panel forming a sequential inner surface for molding when a lower edge of the second panel is brought into contact with the upper edge of the first panel.

6. A formwork apparatus according to claim 5, wherein each of the first and second form panels has a first elongated joining plate attached parallel to one of the upper and lower edges thereof for eliminating a gap between the first and second form panels.

7. A formwork apparatus according to claim 6, wherein each of the first and second form panels has a second elongated joining plate attached parallel to one of opposite side edges thereof for eliminating a gap between the corresponding first or second form panel and a form panel of another formwork apparatus.

8. A formwork apparatus according to claim 7, wherein the first joining plate is attached by hinges to the panel so as to be pivoted about a substantially horizontal axis, and wherein the second joining plate is attached by hinges to the panel so as to be pivoted about a substantially vertical axis.

9. A formwork apparatus according to claim 1, 2, 3, 4, 5, 6, 7 or 8, wherein each of the first and second drive means comprises: an electric motor mounted on the frame assembly; a drive arm connected at one end thereof to a drive shaft of the electric motor so as to be rotated about a horizontal axis parallel to the pivots connecting the panels with the frame assembly, the arm having a through slot formed therein so as to longitudinally extend; and a sliding pin loosely passing through the slot and attached at opposite ends thereof to the corresponding first or second form panel.

10. A formwork apparatus according to claim 9, wherein the frame assembly has a slip ring attached to one of opposite sides thereof for electrically connecting the motor to a power source outside the apparatus.

11. A formwork apparatus according to claim 1, 2, 3, 4, 5, 6, 7 or 8, wherein each of the first and second drive means comprises a cylinder actuator mounted on the corresponding first or second panel, and a crank assembly arranged between the corresponding panel and the frame assembly for changing reciprocating motion of a piston rod of the actuator to the rotary motion of the frame assembly.

12. A formwork apparatus according to claim 11, wherein the actuator is pivotally connected at one end thereof to the corresponding panel, and wherein the crank assembly comprises: a swing arm pivotally connected at one end thereof to the panel and at the other end thereof to the other end of the actuator; and a connecting arm pivotally connected at one end thereof to the other end of the swing arm and at the other end thereof to the frame assembly at a distance from the pivot connecting the panel with the frame assembly, the distance being smaller than a length of the swing arm.

13. A formwork apparatus according to claim 1, wherein each of the first and second fixing means comprises: an anchor member to be embedded in the concrete wall, the anchor member having a screw portion; an engaging bolt member loosely passing through the corresponding form panel, the bolt member having a female screw portion at one end thereof for threadedly engaging with the screw portion of the anchor member; a nut member threadedly engaged with the other end portion of the bolt member projecting from the outer surface of the form panel; a drive motor mounted on the outer surface of the form panel; and a clutch assembly arranged between the drive motor and the bolt member for connecting a drive shaft of the drive motor alternately to the bolt member and the nut member.

14. A formwork apparatus according to claim 13, wherein the bolt member has an extension rod coaxially joined at one end thereof to the other end of the bolt member, the extension rod having first splines mounted on the other end thereof, wherein the nut member has first teeth peripherally formed on one face thereof, and wherein the clutch assembly comprises a cylindrical slider member connected to the drive shaft of the drive motor to be axially slidable while coaxially surrounding the extension rod, the slider member having second teeth circumferentially formed on its end face facing to the nut member and having second splines mounted on the inner face thereof for engaging with the first splines of the extension rod, the first teeth of the nut member being engaged with the second teeth of the slider member when the slider member slides toward the nut member to disengage its second splines from the first splines of the extension rod.

15. A formwork apparatus according to claim 14, wherein the clutch assembly further comprises a slider driving unit for sliding the cylindrical slider member in its axial direction.

16. A formwork apparatus according to claim 1, wherein each of the first and second fixing means comprises: a drive motor mounted on the outer surface of the corresponding form panel; an anchor member to be embedded in the concrete wall, the anchor member having a screw portion; an engaging bolt member loosely passing through the form panel, the bolt member having a female screw portion at one end thereof for threadedly engaging with the screw portion of the anchor member; a nut member threadedly engaged with the other end portion of the bolt member projecting from the outer surface the form panel, the nut member connected to a drive shaft of the drive motor; braking means for preventing the bolt member from being rotated when the bolt member undergoes a torque less than predetermined torque; and stopper means securing the nut member to the bolt member when the nut member is brought into contact therewith.

17. A formwork apparatus according to claim 16, wherein the stopper means comprises a rod piece coaxially joined to the other end of the bolt member, the rod piece having a larger diameter than the other end portion of the bolt member.

18. A formwork apparatus according to claim 17, wherein the braking means comprises a flange circumferentially mounted on the rod piece to radially project, and a clamp connected to the corresponding form panel to be axially slidable, the clamp holding the flange with a predetermined clamping force.

19. A formwork apparatus according to claim 18, wherein each of the first and second fixing means further comprises biasing means for biasing the bolt member axially forward, and bolt retracting means for moving the bolt member axially backward against the biasing force of the biasing means.

20. A formwork apparatus according to claim 5, further comprising first position correcting means for bringing the upper edge of the first panel to a level in which a fixing position of the first panel is corrected, and second position correcting means for bringing the upper edge of the second panel to a level in which a fixing position of the second panel is corrected.

21. A formwork apparatus according to claim 20, wherein each of the position correcting means comprises: a pair of elongated through holes formed in opposite side edge portions of the corresponding form panel so as to extend along respective side edges of the form panel; a pair of mobile members connected to the form panel so as to move along the respective elongated holes; adjusting means for adjusting positions of the respective mobile members relative to the elongated holes so that the mobile members are brought to respective desired positions thereof; and a pair of anchor bolts passing through both the respective mobile members and the respective elongated holes, the anchor bolts to be embedded in the concrete wall to fix the form panel to the concrete wall.

22. A formwork apparatus according to claim 20, wherein each of the position correcting means comprises: a guide frame interposed between the corresponding form panel and its supporting member so as to extend along a side edge of the form panel; a pair of pivotal joint pins perpendicularly connected to opposite side edge portions of the form panel, each of the joint pins connected to the guide frame so as to be movable along the guide frame; and adjusting means for adjusting positions of the respective joint pins relative to the guide frame so that the joint pins are brought to respective desired positions thereof.

23. A formwork apparatus according to claim 22, wherein the guide frame is pivotally connected at a lower end thereof to the supporting member of the corresponding form panel so as to be pivoted about an axis parallel to the pivot connecting the first panel with the frame assembly, and wherein the supporting member has means for adjusting an angle of the guide frame relative thereto.

24. A formwork apparatus according to claim 1, wherein the frame assembly has a scaffold pivotally connected thereto and a docking space defined therein for receiving the scaffold therein.

25. A formwork apparatus according to claim 24, wherein the scaffold is connected to the frame assembly so as to be pivoted about an axis parallel to the pivot connecting the first panel with the frame assembly, and wherein the frame assembly has means for adjusting an angle of the scaffold relative thereto.

* * * * *